United States Patent [19]

Dworkin

[11] 4,388,958

[45] Jun. 21, 1983

[54] FOLDER WITH POCKET

[76] Inventor: Lawrence W. Dworkin, 24 White Oak Dr., North Caldwell, N.J. 07006

[21] Appl. No.: 333,028

[22] Filed: Dec. 21, 1981

[51] Int. Cl.[3] ..... B65D 27/08

[52] U.S. Cl. ..... 150/7; 150/52 B; 206/216

[58] Field of Search ..... 150/7, 52 B; 206/216, 206/232, 425; 229/72

[56] References Cited

U.S. PATENT DOCUMENTS 3,311,145 3/1967 Zalk et al. ..... 150/7

3,557,853 1/1971 Jones ..... 150/7

*Primary Examiner*—Donald F. Norton

*Attorney, Agent, or Firm*—Anthony F. Cuoco

[57] ABSTRACT

A folder with pocket is disclosed which includes front and back sheets (2, 4) and means (6, 8) for joining said sheets along their bottom (10) and corresponding side edges (12), whereby a folder having an open side (14) and an open top (15) for receiving correspondence and the like is provided. A pocket member (16) is joined to one of the front and back sheets (2, 4) for forming therewith a pocket (18) having an open top (19) for receiving word storage media or the like related to the correspondence. A closure member (20) is joined to the one of the front and back sheets (2, 4) relative to the pocket member (16) for providing a closable pocket (18).

9 Claims, 5 Drawing Figures

FOLDER WITH POCKET

BACKGROUND OF THE INVENTION

The rapidly increasing use of word processing equipment necessitates the orderly association of word storage media such as tape cassettes and the like and material related thereto.

For purposes of illustration, common office procedure involves dictating correspondence into a tape recorder of the type using a tape cassette as a word storage medium. Upon completion of the dictation, the tape cassette and related material is transmitted to a stenographer who transcribes the dictated material into word processing equipment and may transmit a printout along with the tape cassette and related material to the originator for proofreading, correction and/or editing, as the case may be. In circumstances such as this, it is necessary that the tape cassette, printout and associated material be kept together in order to avoid confusion and otherwise poor office procedure.

Prior to the present invention conventional envelopes, clips, rubber bands and the like were required to ensure that the tape cassette and associated material were kept in close association. The present invention facilitates this requirement and is particularly advantageous in large facilities involving a large flow of correspondence and/or documentation. Accordingly, it is the object of this invention to provide a folder with pocket whereby tape cassettes and the like and associated material may be kept in close association with minimal chance of loss or separation.

SUMMARY OF THE INVENTION

This invention contemplates a folder with pocket whereby word storage media and associated material may be kept in close association as is desirable. A folder is formed from a pair of flexible, relatively thick gauge sheet like members. The members are joined along their bottom and one of their corresponding side edges, whereby the folder has an open side and top for receiving the associated material. One of the sheets, preferably the front sheet, of the folder has disposed on the outside thereof a member extending partially along the length thereof and which member is a flexible, relatively thin gauge sheet. The relatively thin gauge sheet is joined at its bottom and sides to the one of the front and back sheets so as to form a pocket therewith having an open top for receiving the word storage media. A closure member is joined to the one sheet relative to the pocket member for providing a closable pocket.

DESCRIPTION OF THE INVENTION

Figure 2:
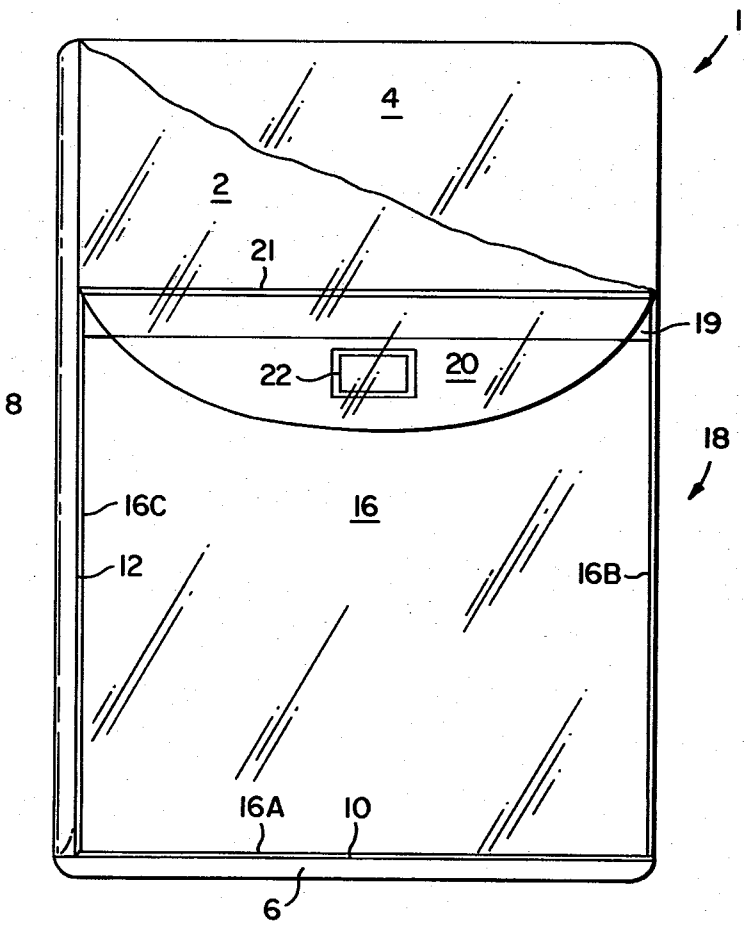
FIG. 2 is a partially cutaway front plan view of the invention best illustrating the back sheet of the folder.
Figure 1:
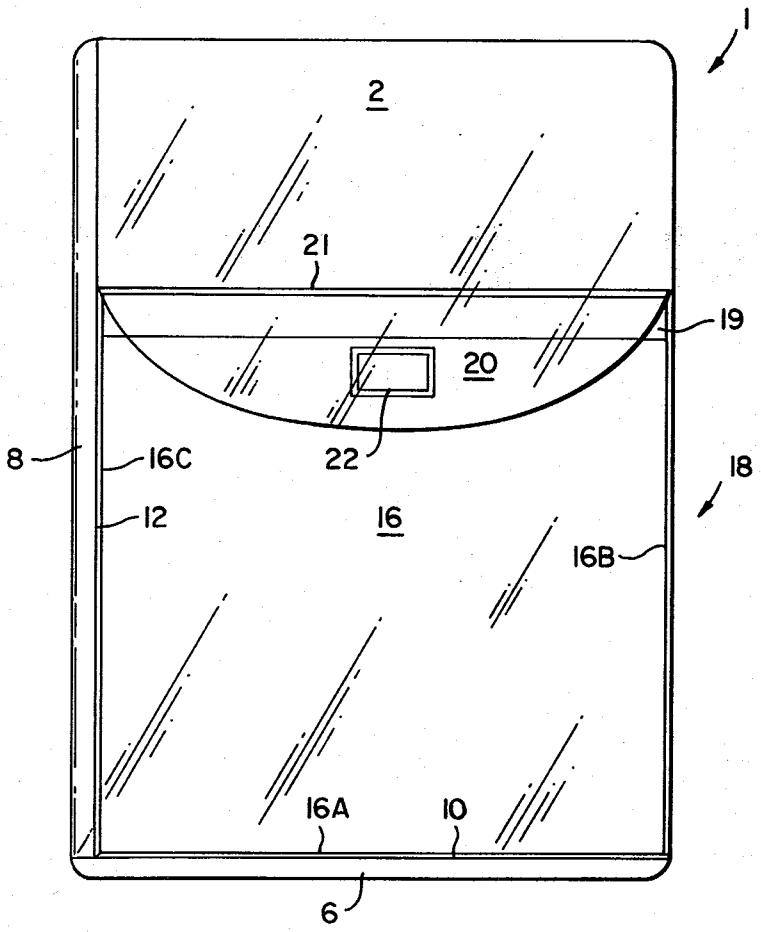
FIG. 1 is a front plan view of the invention.

With reference to the drawing, the invention features a folder 1 including a pair of relatively thick gauge (0.015 inches, for example) flexible, transparent vinyl sheets designated by the numerals 2 and 4. Sheet 2 will be considered to be the front sheet and sheet 4 will be considered to be the back sheet of folder 1.

Figure 5:
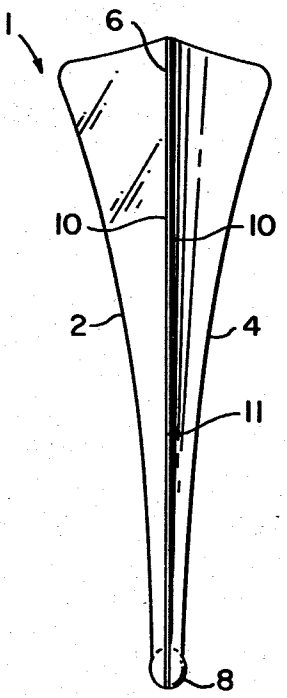
FIG. 5 is a bottom perspective view of the invention looking toward the closed bottom.
Figure 4:
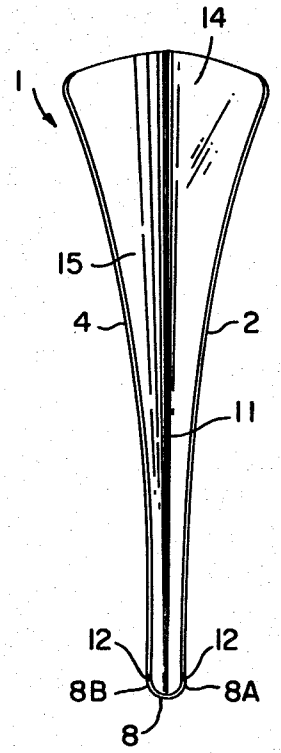
FIG. 4 is a top perspective view of the invention looking toward the open side.
Figure 3:
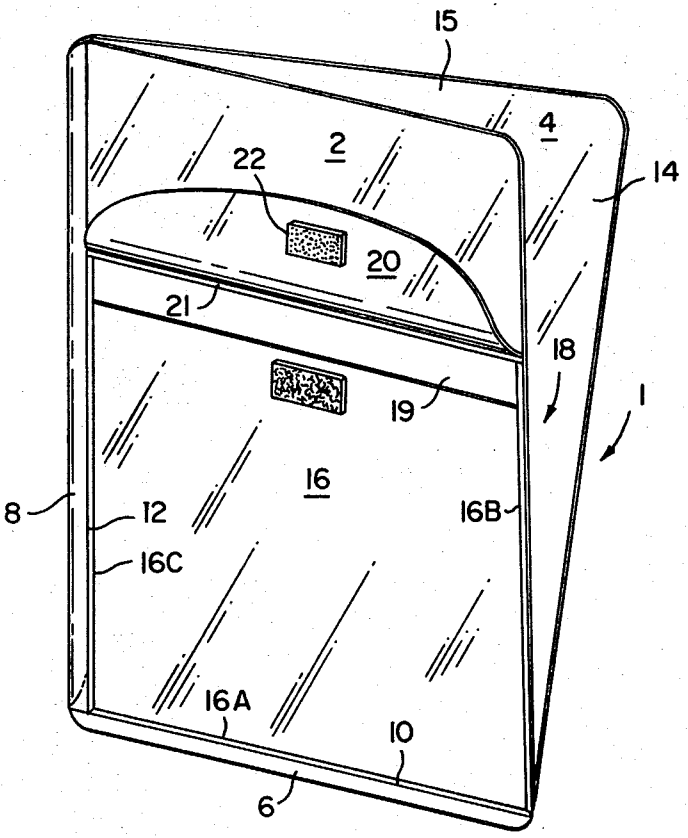
FIG. 3 is an isometric representation of the invention best illustrating the open side and top of the folder.

Sheets 2 and 4 are joined along corresponding bottom and side edges 10 and 12, respectively by, members 6 and 8 respectively, as best shown in FIGS. 4 and 5. Members 6 and 8 may be relatively rigid plastic members which are heat sealed to the corresponding sheet edges to provide a durable joint as will now be understood by those skilled in the art.

In this connection it is noted that member 8 is a U-shaped member having legs 8A and 8B joined to edges 12 of sheets 2 and 4, respectively, whereby the sheets are maintained apart at top 15 and side 14 of folder 1.

Member 6, on the other hand, is strap-like member having joined thereto bottoms 10 of sheets 2 and 4, whereby the sheets are maintained together to provide folder 1 with a closed bottom 11.

With the configuration as shown and described, open side 14 of folder 1 extends longitudinally along the length of the folder and open top 15 extends transversely along the width thereof.

A relatively thin gauge flexible, transparent vinyl pocket member designated by the numeral 16 is disposed on one of the front and back sheets, but preferably on front sheet 2 on the outside surface thereof, and is joined to sheet 2 along its bottom and side edges 16A, 16B and 16C, respectively, by heat sealing or the like to provide a durable joint as will be understood by those skilled in the art. Pocket member 16 may be about half the thickness of sheets 2 and 4 or 0.008 inches, for example. With the arrangement shown, pocket member 16 forms a pocket 18 with sheet 2, and which pocket has an open top 19.

A closure member 20 is disposed on sheet 2 and is heat sealed thereto along a transversely extending edge 21 so that edge 21 is parallel to bottom edges 10 of joined sheets 2 and 4. Closure member 20 may likewise be of a relatively thin, flexible transparent vinyl material and may be folded over at edge 21 to overlap pocket 18 as shown in the drawing.

In this connection, the inside of closure member 20 and the outside of pocket member 16 may have correspondingly positioned Velcro squares 22 thereon. Upon folding closure member 21 to overlap pocket 18, the aforenoted Velcro squares mesh to provide a locking closure for the pocket.

In utilizing the invention as described and shown, a tape cassette or the like onto which correspondence or the like has been dictated may be inserted in the described pocket 18, and the pocket thereupon closed via closure 20. Related material may be inserted in folder 1. The folder 1 is thereupon transmitted to a stenographer or the like for processing. Upon completion of the processing, the resulting material and the related material is inserted in folder 1. The tape cassette is likewise inserted in the folder pocket which is thereupon closed. The folder containing the cassette and processed material and related material is then transmitted to the originator for review, proof reading, editing or the like as may be required.

There has thus been described a folder with pocket which facilitates the transmission of word processing media and associated material. Appropriate legend may be applied to the folder for identification purposes as may be desired.

Although only one structural arrangement has been described in detail other arrangements are within the scope of the invention. For example, sheets 2 and 4 and pocket member 18 may be opaque rather than transparent. Likewise, pocket 18 may be disposed on the outside surface of back sheet 4. While the drawings show the pocket extending across the width of the appropriate file sheet, the pocket may be larger or smaller as is required. Accordingly, reference is had to the appended claims for a definition of the invention.

Having thus described the invention, what is claimed is:

1. A folder with pocket, comprising:

a relatively thick front sheet of a flexible material;

a relatively thick back sheet of a flexible material;

means for joining the bottom edges of the front and back sheets;

means for joining a side edge of the front sheet and a corresponding side edge of the back sheet;

the joined sheets forming a folder with an open side opposite the joined sides, an open top and a closed bottom;

a relatively thin flexible pocket member joined along its bottom and side edges to the external side of one of the front and back sheets, and extending partially along the length thereof for forming a pocket having an open top therewith; and a relatively thin flexible closure member joined to the external side of the one of the front and back sheets relative to the pocket member for overlapping the pocket member upon closure, whereby a closable pocket is provided.

2. A folder with pocket as described by claim 1, wherein the means for joining the bottom edges of the front and back sheets includes:

a strap-like member having the bottom edges joined thereto, whereby the sheets are maintained together to provide a folder with a closed bottom.

3. A folder with pocket as described by claim 2, wherein:

the strap-like member is of a relatively rigid vinyl material.

4. A folder with pocket as described by claim 1, wherein the means for joining a side edge of the front sheet and a corresponding side edge of the back sheet includes:

a U-shaped member having a pair of legs, each of which is joined to the corresponding side edge of a sheet, whereby the sheets are maintained apart to provide a folder having an open top and an open side opposite the joined sides.

5. A folder with pocket as described by claim 4, wherein:

the U-shaped member is of a relatively rigid vinyl material.

6. A folder with pocket as described by claim 1, including:

first means disposed on the inside of the closure member;

second means correspondingly disposed on the outside of the pocket member; and said first and second means being in mating relationship to lock the pocket closed when the closure member overlaps the pocket member.

7. A folder with pocket as described by claim 1, wherein:

the pocket member extends partially along the length of the one of the front and back sheets and substantially along the entire width thereof.

8. A folder with pocket as described by claim 1, wherein:

the front and back sheets, the pocket member and the closure member are of a transparent vinyl material.

9. A folder with pocket as described by claim 1, wherein:

the relatively thick front and back sheets are approximately twice the thickness of the relatively thin pocket and closure members.

* * * * *